US007905766B2

(12) United States Patent
Iwata et al.

(10) Patent No.: US 7,905,766 B2
(45) Date of Patent: Mar. 15, 2011

(54) CENTRIFUGALLY PROJECTING MACHINE

(75) Inventors: Kyoichi Iwata, Toyokawa (JP); Masakatsu Ito, Toyokawa (JP)

(73) Assignee: Sintokogio, Ltd., Aichi (JP)

( * ) Notice: Subject to any disclaimer, the term of this patent is extended or adjusted under 35 U.S.C. 154(b) by 432 days.

(21) Appl. No.: 11/991,412

(22) PCT Filed: Sep. 5, 2006

(86) PCT No.: PCT/JP2006/317561

§ 371 (c)(1),
(2), (4) Date: Mar. 4, 2008

(87) PCT Pub. No.: WO2007/029706

PCT Pub. Date: Mar. 15, 2007

(65) Prior Publication Data

US 2009/0137193 A1 May 28, 2009

(30) Foreign Application Priority Data

Sep. 6, 2005 (JP) ..... 2005-257261
Sep. 12, 2005 (JP) ..... 2005-263589
Jul. 3, 2006 (JP) ..... 2006-182994

(51) Int. Cl.
*B24C 5/06* (2006.01)

(52) U.S. Cl. ..... 451/92; 72/53; 451/95; 451/97; 451/98; 451/99

(58) Field of Classification Search ..... 72/53; 451/92, 451/95, 97, 98, 99
See application file for complete search history.

(56) References Cited

U.S. PATENT DOCUMENTS 3,785,105 A * 1/1974 Freeman ..... 451/97
(Continued)

FOREIGN PATENT DOCUMENTS

JP 49-10189 1/1974
(Continued)

*Primary Examiner* — David B Jones
(74) *Attorney, Agent, or Firm* — Finnegan, Henderson, Farabow, Garrett & Dunner, L.L.P.

(57) ABSTRACT

A centrifugal projecting machine having a house, a driving device disposed at a first side of the housing with a flange, an impeller having a plurality of blades, wherein the impeller is connected to a driving shaft of the driving device with a hub, a distributor disposed in an inner cylindrical space of the impeller so that it is concentrically arranged in relation to the driving shaft, wherein the distributor has slit-like openings that are circumferentially disposed with substantially equal clearances, a control cage having an opening around a distal end for dispersing shot, wherein a proximal end surface of the control cage is connected to the second side of the housing, opposite its first side, around an opening for an intake disposed at its second side, wherein he control cage is disposed with a clearance between inner ends of the blades and an outer surface of the distributor and extends over the length of the impeller, and a nozzle connected to the second side of the housing to supply the opening for an intake with shot, wherein a supporting member is disposed at the side of the impeller to support the rotating impeller, or a rotating member for sealing is disposed between the proximal end of the distributor and the distal end of the control cage, or a bearing is disposed at the clearance between the inner periphery of the flange and an outer periphery of a hub together with damping members.

23 Claims, 3 Drawing Sheets

U.S. PATENT DOCUMENTS

| | | | | | |
|---|---|---|---|---|---|
| 4,333,278 | A | * | 6/1982 | Schulte et al. | 451/97 |
| 4,395,851 | A | * | 8/1983 | Watts | 451/97 |
| 4,480,413 | A | | 11/1984 | Schulte et al. | |
| 4,751,798 | A | * | 6/1988 | McDade | 451/95 |
| 5,024,028 | A | * | 6/1991 | Pierce et al. | 451/95 |
| 5,688,162 | A | * | 11/1997 | Williams | 451/92 |
| 6,949,014 | B2 | * | 9/2005 | Barrier et al. | 451/95 |

FOREIGN PATENT DOCUMENTS

| | | |
|---|---|---|
| JP | 59-27318 B2 | 7/1984 |
| JP | 62-78266 | 5/1987 |
| JP | 62-150056 | 9/1987 |
| JP | 3-36762 | 4/1991 |
| JP | 9-150369 | 6/1997 |

* cited by examiner

CENTRIFUGALLY PROJECTING MACHINE

FIELD OF INVENTION

This invention relates to a centrifugally projecting machine. Particularly, it relates to one that has an impeller to stabilize the rotating balance, and that has reduced maintenance.

BACKGROUND OF THE INVENTION

Conventionally, shot blasting is used for removing rust, burrs, scales, or a composition for coating surfaces of products by projecting shot, such as small rigid spheres, at the products. For the shot blasting, a centrifugally projecting machine is used. It can use centrifugal force to continuously project shot by means of a high-speed rotation of an impeller that has a plurality of blades. For example, Patent Document 1 discloses a centrifugally projecting machine for projecting abrasive grains. This machine is comprised of an impeller having 4 to 12 blades, wherein the blades are radially disposed between rotating plates having a circular shape, and a spinning body that is rotatably mounted on the machine, so that the inner ends of the blades define a space having a substantially cylindrical shape of a diameter of 135 to 170 mm.

It is also comprised of a distributor concentrically arranged in the space defined in the spinning body. The distributor has a cylindrical shape, and has a bottom plate. The distributor extends over the axial length of the spinning body, and has the same number of slit-like openings as that of the blades. The openings are circumferentially disposed with substantially equal intervals.

It is also comprised of a control cage independently fixed at the clearance between the inner ends of the blades and the outer surface of the distributor.

Further, this centrifugally projecting machine is designed so that shot are provided for the blades from the distributor through a hole of the control cage, and then are accelerated and projected at a product to be processed by the blades. However, some of the shot sometimes spill from the clearance between the distributor and the control cage. Thus, liners must be put on the inner side of a cover (a housing) surrounding the impeller to prevent the cover from being abraded by the shot projected in a direction that differs from the direction for processing a target product.

Patent Document 1: Japanese Patent Laid-open Publication No. H9-150369

Object of the Invention

The impeller is cantilevered by means of a driving means (a driving motor) and rotated by it. When the impeller is rotating at high speed, since the amount of shot supplied to the blades of the impeller varies, the impeller is mounted on a machine with a misalignment error, and the rotating parts of the driving motor are worn, the impeller has a dynamic imbalance in its rotation. Thus, the dynamic rotating imbalance causes the impeller to have a vibration caused by the rotation, or causes the housing of the machine to have a noise caused by rotational vibration. When the centrifugally projecting machine is used for a long time, since the loads applied to the rotating parts of the driving motor, such as a bearing that supports the impeller, vary widely, possibly the life of the rotating parts will decrease. To improve the life of the supporting structure of the impeller, it is necessary to use a large bearing that can bear a heavy load, or to use a large driving motor. However, then the size of the machine gets larger, and the cost of it increases. Further, since as a bearing used for supporting a driving shaft the use of a large bearing that can bear a heavy load causes the bearing to have a reduced allowable speed of rotation, and since a small centrifugally projecting machine needs the impeller to rotate at a high speed, a large bearing cannot be used for the machine.

The purpose of this invention is to solve the problems explained in the above paragraph. Namely, it is to provide a centrifugally projecting machine which can improve the life of its driving motor by reducing a rotational vibration caused by a dynamic imbalance of the rotation of an impeller, and that can reduce noise caused by its vibration.

Further, for the centrifugally projecting machine for projecting abrasive grains, the state of the abrasion of the liners must be checked by opening the cover. Then, if it is found that the liners are significantly abraded, they must be replaced with new ones. Thus, there is a problem in that the cost of the maintenance for the machine may increase.

Thus, another purpose of this invention is to provide a centrifugally projecting machine which reduces maintenance by avoiding use of any liners.

SUMMARY OF THE INVENTION

To achieve the purposes explained in the above paragraphs, a centrifugally projecting machine produced in accord with the first viewpoint of this invention comprises:

a housing, a driving means disposed at the outer first side of the housing, an impeller having a plurality of blades, wherein the impeller is connected to a driving shaft of the driving means, a distributor disposed in the inner cylindrical space of the impeller so that it is concentrically arranged in relation to the driving shaft, wherein the distributor has openings that are circumferentially disposed with substantially equal intervals, a control cage having an opening around its distal end for dispersing shot, wherein the proximal end surface of the control cage is connected to the second side of the housing, opposite its first side, around an opening for an intake disposed at its second side, wherein the control cage is disposed at the clearance between the inner ends of the blades and the outer surface of the distributor and extends over the length of the impeller, and a nozzle connected to the second side of the housing to supply the opening for the intake with shot, wherein a supporting member is disposed at the side of the impeller to support the rotating impeller.

By this invention, which has the technical features explained in the above paragraph, since when an impeller rotates at a high speed its vibration caused by a dynamic imbalance of its rotation can be reduced, the life of rotating parts of a driving means, such as a bearing, can be improved.

A centrifugally projecting machine in line with the second point of this invention comprises:

a housing, a driving means disposed at the outer first side of the housing, an impeller having a plurality of blades, wherein the impeller is connected to a driving shaft of the driving means, a distributor disposed in the inner cylindrical space of the impeller so that it is concentrically arranged in relation to the driving shaft, wherein the distributor has openings that are circumferentially disposed with substantially equal intervals, a control cage having an opening around its distal end for dispersing shot, wherein the proximal end surface of the control cage is connected to the second side of the housing, opposite its first side, around an opening for an intake disposed at its second side, wherein the control cage is disposed at the clearance between the inner ends of the blades and the outer surface of the distributor and extends over the length of the impeller, and a nozzle connected to the second side of the housing to supply the opening for the intake with shot, wherein a rotating member for sealing the clearance is disposed between the proximal end of the distributor and the distal end of the control cage.

By this invention, which has the technical features explained in the above paragraph, since a leakage of shot from the clearance between the proximal end of the distributor and the distal end of the control cage can be prevented by plugging the clearance with a rotating member for sealing it, eliminating liners. Further, since using the liners can be avoided, the maintenance of the centrifugally projecting machine can be reduced.

A centrifugally projecting machine produced in accord with the third point of this invention comprises:

a housing, a driving means disposed at the first side of the housing by means of a flange, an impeller having a plurality of blades, wherein the impeller is connected to a driving shaft of the driving means by means of a hub, a distributor disposed in the inner cylindrical space of the impeller so that it is concentrically arranged in relation to the driving shaft, wherein the distributor has slit-like openings that are circumferentially disposed with substantially equal clearances, a control cage having an opening around its distal end for dispersing shot, wherein the proximal end surface of the control cage is connected to the second side of the housing, opposite its first side, around an opening for an intake disposed at its second side, wherein the control cage is disposed at the clearance between the inner ends of the blades and the outer surface of the distributor and extends over the length of the impeller, and a nozzle connected to the second side of the housing to supply the opening for an intake with shot, wherein a bearing is disposed at the clearance between the inner periphery of the flange and an outer periphery of a hub together with damping members.

By this invention, which has the technical features explained in the above paragraph, since the damping members can act as a vibration insulator, the vibration of the driving motor (the driving means) and the housing caused by a dynamic imbalance of the rotating impeller can be reduced. Thus, the life of the driving motor can be improved, and the noises caused by the vibration of the driving motor and the housing can be reduced.

BRIEF DESCRIPTIONS OF THE DRAWINGS

PREFERRED EMBODIMENTS OF THE INVENTION

Figure 1:
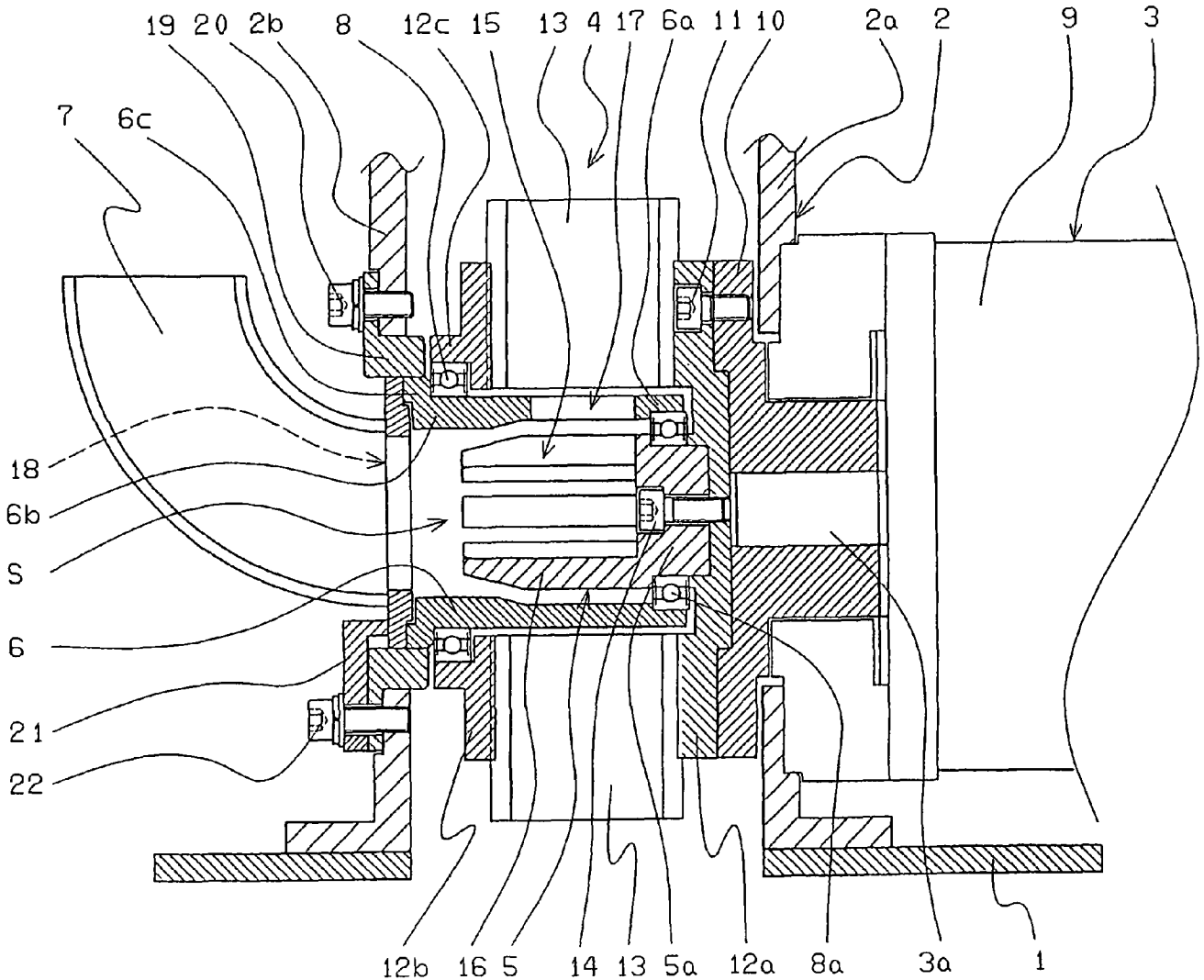
FIG. 1 shows a sectional view of a main part of the centrifugal projecting machine of the first embodiment of this invention.

Below, the centrifugally projecting machine of this invention is explained based on the figures. As shown in FIG. 1, the centrifugally projecting machine of the first embodiment of this invention comprises:

a housing 2 (a casing for the impeller) disposed on a top surface 1 of a box for projecting shot from a main body of the machine, a driving means 3 disposed on the top surface 1 and at the outer first side 2*a* of the housing 2, an impeller 4 connected to a driving shaft 3*a* of the driving means 3, a distributor 5 disposed in the inner cylindrical space S of the impeller 4 so that it is concentrically arranged in relation to the driving shaft 3*a*, a control cage 6 connected to a second side 2*b* of the housing 2, opposite its first side 2*a*, a nozzle 7 connected to the second side 2*b* of the housing 2, and a supporting member 8 disposed between the second side-plate of the impeller 4 and the proximal end 6*b* of the control cage 6.

The means for supporting the impeller is not limited to the supporting member 8. To support the rotating impeller at the side plates of the impeller, another supporting member 8*a* can be used at the clearance between the distributor disposed at the first side-plate of the impeller, where the driving shaft is located, and the distal end of the control cage, instead of, or together with, the supporting member 8. Below, the supporting member 8 is explained in detail.

The driving means 3 is not limited to a particular device. A driving motor having a bearing (not shown) for rotatably supporting the driving shaft 3*a* can be used as the driving means. If the driving shaft 3*a* is rotatably supported by another bearing of a bearing unit, the driving means 3 can be comprised of the bearing unit, a pulley connected to the end of the driving shaft 3*a*, a driving motor, another pulley connected to the rotating shaft of the driving motor, and a belt wound around the pulley of the driving shaft 3*a* and that of the driving motor.

The impeller 4 of the first embodiment is connected to the driving shaft 3*a* by bolts 11 by means of a hub 10. The impeller 4 is comprised of a first side-plate 12*a* located near the driving shaft 3*a* of the driving means 3, a second side-plate 12*b* located near the nozzle 7 and apart from the first side-plate 12*a* for a predetermined distance, and a plurality of blades 13, as for example, 4 to 12 blades 13, radially located between the first side-plate 12*a* and the second side-plate 12*b*. The second side-plate 12*b* of the impeller 4 has an opening larger than the outer diameter of the control cage 6 at its central portion. The blades 13 are attached to the first side-plate 12*b* so that the inner periphery of the first side-plate 12*b* substantially corresponds to the inner ends of the blades. Here, the first side-plate 12*a* of the impeller 4 is separately made from the hub 10. The first side-plate 12*a* is not limited to this configuration. It is possible to integrate the first side-plate 12*a* with the hub 10.

The distributor 5 is used for stirring shot and is connected to the first side-plate 12*a* by bolts 14. The distributor 5 has slit-like openings 15 that are circumferentially disposed with substantially equal intervals. The number of slit-like openings is the same as, or less than, or more than, that of the blades. Namely, the distributor 5 of the first embodiment has the same number of comb-like projections 16 as that of the blades 13. The projections are parallel to the centerline of the impeller 4, and extend from the proximal end 5*a* of the distributor 5 (in the horizontal direction of FIG. 1). The distributor 5 of this invention is not limited to this configuration. The comb-like projections 16 may be circumferentially connected to each other at their distal portions, to strengthen the distributor 5.

The control cage 6 is used for controlling the direction for projecting the shot by the opening 17 for dispersing the shot. The opening 17 is disposed at the distal end 6*a* of its cylindrical portion. The control cage 6 is disposed at the clearance between the distributor 5 and the blades 13 and extends over the length of the impeller. Further, the surface of the proximal end 6*b* of the control cage 6 is connected to the second side 2*b* of the housing 2, opposite its first side 2*a*, around the opening 18 for the intake. Next, the structure of this embodiment for connecting the control cage 2 to the housing 2 is explained below. First, a fitting 19, having a ring-shaped flange, is connected to the opening 18 for the intake of the second side 2*b* of the housing 2 by bolts 20. After the control cage 6 is inserted into the housing 2 along the inner periphery of the fitting 19, the shoulder portion 6*c*, formed at the proximal end 6*b* of the control cage 6, is sandwiched between the surface of the end of the supporting member 8 and that of the nozzle. Then, the control cage 6 is pressed toward the supporting member 8 by a member 21 for holding the nozzle and is fixed to the housing 2 by bolts 22.

The nozzle 7 is used for supplying the impeller 4 with the shot. It is connected to the second side 2*b* of the housing 2 to supply the shot for the opening 18 for the intake. If the clearance between the inner surface of the control cage 6 and the outer surface of the distributor 5 is under 7 mm, the efficiency of projecting the shot is very low. If it is over 14 mm, the efficiency of projecting the shot is at its highest, and has constant value. Thus, it is preferable that the clearance be designed to be between 7 mm and 14 mm.

The supporting member 8 may be disposed between the side of the impeller 4 and the proximal end 6*b* of the control cage 6. It is not limited to this configuration. For the first embodiment, the supporting member 8 is disposed between the protruding portion 12*c* of the second side-plate 12*b* of the impeller 4 and the proximal end 6*b* of the control cage 6. The supporting member 8 is located at the side of the control cage 6, facing the nozzle, namely, between the opening 17 for dispersing the shot, of the control cage 6, and the nozzle 7. It is inserted into the protruding portion 12*c* of the second side-plate 12*b* facing the nozzle 7, of the impeller 4, and supports the rotating impeller 4.

The supporting member 8 may rotatably support the impeller on the control cage 6. Thus, it is not limited to the configuration explained in the above paragraph. A supporting member that is proper for the materials from which the shot are made, or their size, or speed of rotation, or the operating temperature, can be selected. For example, a rolling bearing having a sealing member made of steel or rubber, an oil-impregnated sintered bearing, or a ceramic bearing, can be used for the supporting member. Further, instead of a bearing, ring-shaped sliding members made of materials such as ceramics, oil-impregnated sintered material, a hard resin having a high performance in slidability, or metallic materials, can be used as the supporting member 8. Further, as a ring-shaped sliding member, a plurality of materials, such as ceramics, oil-impregnated sintered material, a hard resin having a high performance in slidability, or metallic materials, can be used by laying them in the circumferential direction.

Since the bearings or the ring-shaped sliding members can support the radial load caused by all of the vibrations, it is preferable to use bearings or ring-shaped sliding members.

For the first embodiment of this invention, the distributor 5 is supplied with the shot from the nozzle 7 through the control cage 6. The shot are stirred in the rotating distributor 5. The shot that are stirred in the control cage 6 are supplied to the inner portion of the rotating blades 13 through the opening 17 for dispersing the shot, of the control cage 6. The speed of the shot that are supplied to the blades 13 is gradually accelerated by the rotating blades 13. The shot are ejected from the periphery of the blades 13 and are projected at a product which is to be processed, to remove rust, burrs, scales, or a composition for coating the surface of the product.

As explained in the above paragraphs, for the first embodiment of this invention, since when the impeller 4 rotates at a high-speed its vibration caused by a dynamic imbalance of its rotation can be reduced, the life of the rotating parts of the driving means 3, such as a bearing, can be improved.

For the first embodiment of this invention, since the load caused by the vibration and applied to the bearing of the driving means 3 can be supported by the supporting member 8, when the centrifugally projecting machine is routinely maintained only the exchange of the supporting member 8 is required. Thus, since the frequency of the exchange of the bearing or bearing unit (a driving motor) of the driving means, which exchange is costly and requires more man-hours, can be reduced, the machine can be easily maintained, and the costs for maintaining it can also be reduced.

Figure 2:
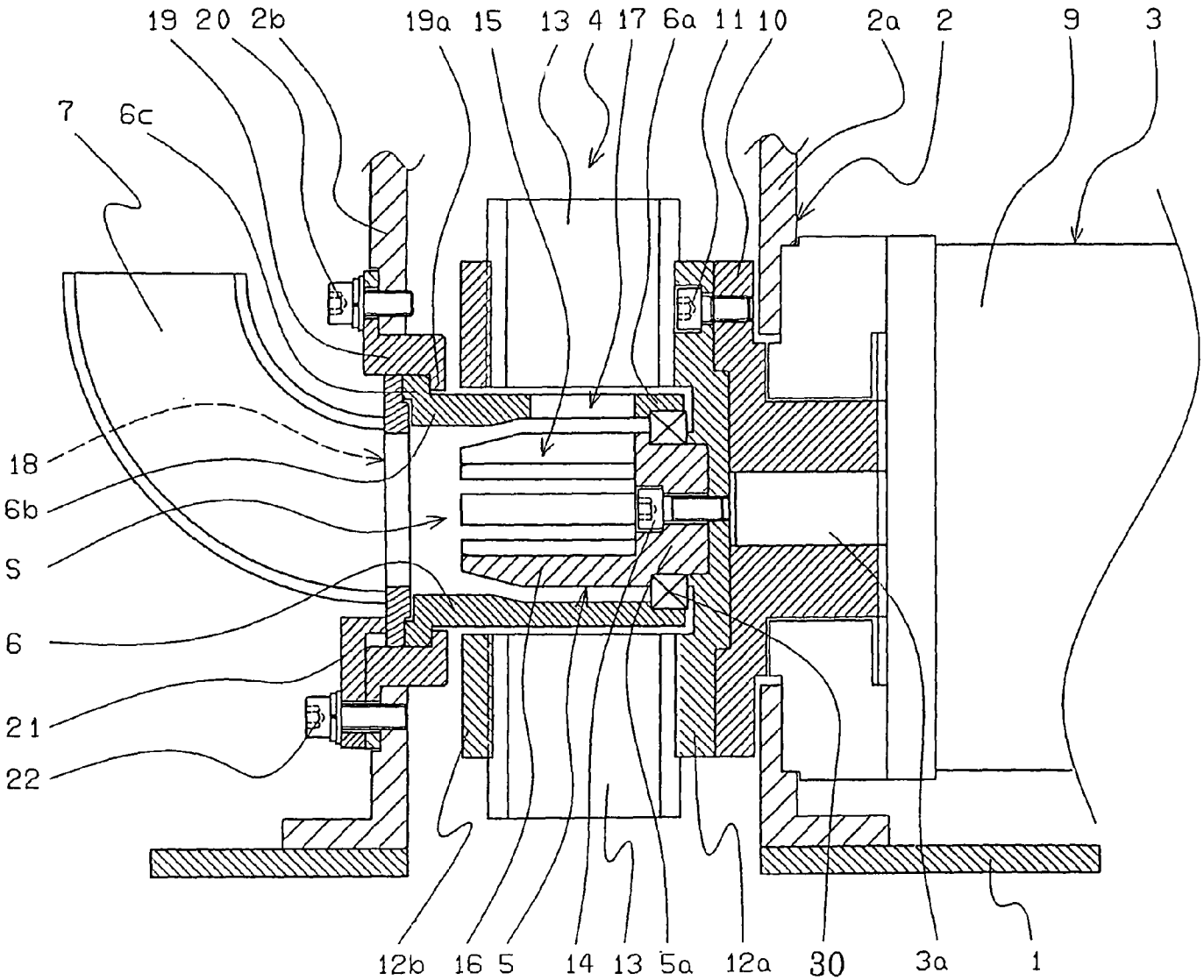
FIG. 2 shows a sectional view of a main part of the centrifugal projecting machine of the second embodiment of this invention.

FIG. 2 shows the centrifugally projecting machine of the second embodiment of this invention. This machine has many elements that have the same constitution as that of the first embodiment. Thus, below, the explanations of the elements having the same constitution are omitted. Below, only the elements that differ from those of the first embodiment are explained.

About the centrifugally projecting machine of the first embodiment, the machine comprises the supporting member 8 disposed between the side of the impeller 4 and the proximal end 6*b* of the control cage 6. However, for the centrifugally projecting machine of the second embodiment, the machine comprises a rotating member 30 for sealing. It is disposed between the proximal end 5*a* of the distributor 5 and the distal end 6*a* of the control cage 6, instead of the supporting member 8.

Further, for the centrifugally projecting machine of the first embodiment, the following structure is used for connecting the control cage 6 to the housing 2. Namely, first, a fitting 19 having a ring-shaped flange is connected to the opening 18 for the intake of the second side 2*b* of the housing 2 by bolts 20. After the control cage 6 is inserted into the housing 2 along the inner periphery of the fitting 19, the shoulder portion 6*c*, formed at the proximal end 6*b* of the control cage 6, is sandwiched between the surface of the end of the supporting member 8 and that of the nozzle. Then, the control cage 6 is pressed toward the supporting member 8 by a member 21 for holding the nozzle and is fixed to the housing 2 by bolts 22.

However, for the centrifugally projecting machine of the second embodiment, instead of the structure for connecting the control cage 6 of the first embodiment, the following structure is used. Namely, first a fitting 19 having a ring-shaped flange is connected to the opening 18 for the intake of the second side 2*b* of the housing 2 by bolts 20. Then the control cage 6 is inserted into the housing 2 along the inner periphery of the fitting 19. The shoulder portion 6*c*, formed at the proximal end 6*b* of the control cage 6, is sandwiched between the surface of a protruding portion 19*a*, formed at the fitting 19, having a ring-shaped flange, and the surface of the end of the nozzle 7. Then the control cage 6 is pressed by a member 21 for holding the nozzle 7 and is fixed to the housing 2 by bolts 22.

The rotating member 30 for sealing the clearance of the centrifugally projecting machine of the second embodiment is not limited to a particular one. For example, ring-shaped sliding members made of materials such as ceramics, oil-impregnated sintered material, a hard resin having a high slidability, or metallic materials, may be used for the rotating member 30. Further, structural members comprising a ball bearing having a sealing member made of steel or rubber, an oil-impregnated sintered bearing, or a ceramic bearing that is combined with a ring-shaped steel plate, can be used for the rotating member 30. The rotating member 30 for sealing can bear the force caused by the shot and can prevent the leakage of the shot. Since the rotating member 30 for sealing can also act as a supporting member to support the rotating impeller 4, the rotating member 30 for sealing can reduce the vibration caused by a dynamic imbalance of the rotation of the impeller 4. The method for assembling the rotating member 30 for sealing is not limited to a specific one. For the second embodiment, the inner portion of the rotating member 30 is sandwiched between a cylindrical shoulder formed at the proximal end 5*a* of the distributor 5 and a cylindrical and protruding portion formed at the first side-plate 12*a* of the impeller 4. Then the outer portion of the rotating member 30 is loosely fitted to a cylindrical groove of the distal end 6*a* of the control cage 6.

For the centrifugally projecting machine of the second embodiment of this invention, the distributor 5 is supplied with the shot from the nozzle 7 through the control cage 6. The shot are stirred in the rotating distributor 5.

The shot that are stirred in the control cage 6 are supplied to the inner portion of the rotating blades 13 through the opening 17 for dispersing the shot, of the control cage 6. Then, the rotating member 30 for sealing prevents the shot from being projected at the inner surface of the housing 2. The speed of the shot that are supplied to the blades 13 is gradually accelerated by the rotating blades 13. The shot are ejected from the periphery of the blades 13 and are projected at a product that is to be processed to remove rust, burrs, scales, or a composition for coating the surface of the product.

Figure 3:
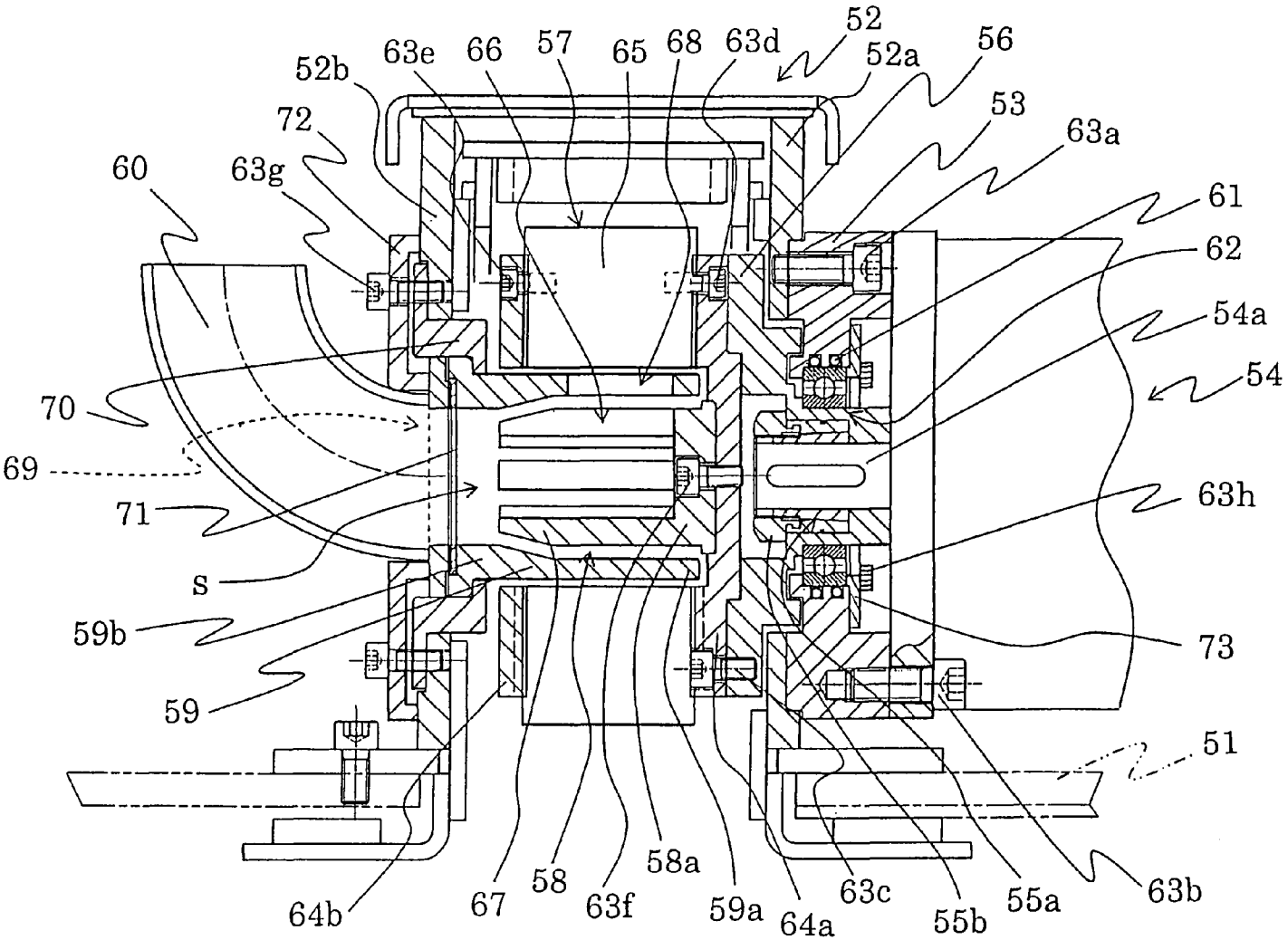
FIG. 3 shows a sectional view of a main part of the centrifugal projecting machine of the third embodiment of this invention.

FIG. 3 shows a centrifugally projecting machine of the third embodiment of this invention.

The centrifugally projecting machine of the third embodiment comprises:

a housing 52 (a casing for an impeller) disposed on a top surface 51 of a box for projecting shot from a main body of the machine, a driving motor 54 (a driving means) disposed at the first side 52*a* (a cover) of the housing 52 by means of a flange 53, an impeller 57 connected to a driving shaft 54*a* of the driving motor 54 by means of a hub 56 that is connected to the driving shaft 54*a* by a tapered locking device comprising a tapered sleeve 55*a* and a tapered locking nut 55*b*, a distributor 58 disposed in the inner cylindrical space S of the impeller 57 so that it is concentrically arranged in relation to the driving shaft 54*a*, a control cage 59 connected to a second side 52*b* of the housing 52, opposite its first side 52*a*, and a nozzle 60 connected to the second side 52*b* of the housing 52, wherein a bearing 62 is disposed at the clearance between the inner periphery of the flange 53 and an outer periphery of a hub 56 together with damping members 61 disposed at the inner periphery of the flange 53. The driving motor 54 is connected to the flange 53 by the bolts 63*b*. The flange 53 is connected to the first side 52*a* of the housing 52*a* by the bolts 63*a*, and is supported by the top surface 51. The driving motor 54 is not limited to a specific one. A driving motor that has a plurality of bearings (not shown) for rotatably supporting the driving shaft 54*a* may be used. If the driving shaft 54*a* is rotatably supported by another bearing of a bearing unit that has no driving source, the driving motor 54 can be comprised of the bearing unit, a pulley connected to the end of the driving shaft 54*a*, a motor, another pulley connected to the rotating shaft of the motor, and a belt wound around the pulley of the driving shaft 54*a* and that of the motor.

The impeller 57 is comprised of a first side-plate 64*a* located near the driving shaft 54*a* of the driving motor 54. The plate 64*a* is connected to the driving shaft 54*a* by means of the hub 56 by the bolts 63*c*, a second side-plate 64*b* located near the nozzle 60 and apart from the first side-plate 64*a* for a predetermined distance, and a plurality of the blades 65, as for example, 4 to 12 blades 13 radially located between the first side-plate 64*a* and the second side-plate 64*b*. The first side-plate 64*a* and the blades 65 are connected to each other by bolts 63*d*. The second side-plate 64*b* at its central portion has an opening having a larger diameter than that of the control cage 59. The second side-plate 64*b* and the blades 65 are connected to each other by bolts 63*e* so that the inner periphery of the second side-plate 64*b* corresponds to the inner ends of the blades 65.

The distributor 58 is used for stirring shot. It is connected to the first side-plate 64*a* by bolts 63*f*. The distributor 58 has slit-like openings 66 that are circumferentially disposed with substantially equal intervals. The number of slit-like openings 66 is the same as, less than, or more than that of the blades. Namely, the distributor 58 of the third embodiment has the same number of comb-like projections 67 as that of the blades 65. The projections 67 are parallel to the centerline of the impeller 57 and extend from the proximal end 58*a* of the distributor 58 (in the horizontal direction of FIG. 3). The distributor 58 of this invention is not limited to this configuration. The comb-like projections 67 may be circumferentially connected to each other at their distal portions to strengthen the distributor 58.

The control cage 59 is used for controlling the direction for projecting the shot by the opening 68 for dispersing the shot, disposed at the distal end 59*a* of its cylindrical portion. The control cage 6 is disposed at the clearance between the distributor 58 and the blades 65 and extends over the length of the impeller 57. Further, the surface of the proximal end 59*b* of the control cage 59 is connected to the second side 52*b* of the housing 52, opposite its first side 52*a*, around the opening 69 for the intake of the second side 52*b*. Next, the structure of this embodiment for connecting the control cage 59 to the housing 52 is explained. First, a fitting 70, having a ring-shaped flange, is connected to the opening 69 for the intake of the second side 52*b* of the housing 52. Then, the control cage 59 is inserted into the fitting 70 so that the shoulder portion of the control cage 59 is pressed to the shoulder portion of the fitting 70, and so that their positions are adjusted to each other. Next, after a sealing plate 71 is placed on the end surface of the control cage 59, the nozzle 60 is inserted into the fitting 70 and connected to the second side 52*b* of the housing 52 by the bolts 63*g* by means of a ring-shaped member 72 for holding the nozzle 60. Based on these assembling procedures, the control cage 59 and the nozzle 60 for supplying the shot to the impeller 57 are connected to the second side 52*b* of the housing 52.

The damping members 61 can be made of material that is selected from the group of a rubber, a resin material, and a metal material for damping. For this embodiment, O-rings are used as the damping members 61. The O-rings are disposed at a pair of ring-shaped grooves formed at the inner periphery of the flange 53. As the resin material, the urethane series, the ester series, or the amide series, can be used. As the metal material for damping, the Mn—Cu alloy series, or the Ni—Ti alloy series, can be used. Further, as the damping members 61, a material that is made by combining the rubber, the resin material for damping, and the metal material for damping, can be used. The structure of the damping members 61, such as its location and its shape, is not limited to the one explained here. For example, a structure having ring-shaped damping members 61 that is integrally formed around the outer periphery of the outer ring of the bearing 62 and that has a rectangular sectional shape can be used. Further, a structure using, for example, O-rings as the damping members 61, which O-rings are placed in the ring-shaped grooves that are formed around the outer periphery of the outer ring of the bearing 62, or a structure using the spiral-shaped damping members 61 that are placed in the spiral-shaped groove that are formed around the outer periphery of the outer ring of the bearing 62, can be used.

Further, the bearing 62 may be a ball bearing with deep grooves having a steel seal or a rubber seal (not shown). The outer ring of this ball bearing is pressed laterally by means of a ring-shaped pressing member 73 that is fixed to the flange 53 by bolts 63*h*. After installing the O-rings in the ring-shaped grooves that are formed around the inner periphery of the flange 53, the bearing 62 is inserted into the flange 53 with a tolerance set between the outer diameter of the outer ring of the bearing and the inner diameter of the O-rings. This tolerance allows the O-rings to be elastically deformed.

For the third embodiment, the damping members 61 act to reduce the vibration of the machine. Thus, since when the impeller 57 rotates at a high-speed the vibration of the driving motor caused by a dynamic imbalance of its rotation can be reduced, and the life of the rotating parts of the driving motor 54, such as a bearing, can be improved. Further, the noises caused by the vibration of the housing 52 can be reduced.

For this embodiment, it is above explained that the ball bearing with deep grooves having a seal is used for the bearing 62. In this invention, however, a ceramic ball bearing may also be selected for the bearing 62. A ball bearing at least having balls that are made of ceramic is preferable. Further, it is preferable to use a double row bearing, instead of a single row bearing such as the bearing 62.

What we claim is:

1. A centrifugal projecting machine comprising:

a housing, a driving means having a driving shaft disposed at a first side of the housing, a rotating impeller having a plurality of blades, the impeller being connected to the driving shaft of the driving means for rotation, a distributor disposed in an inner cylindrical space of the impeller so that it is concentrically arranged in relation to the driving shaft, the distributor having openings that are circumferentially disposed at substantially equal intervals, a control cage having an opening around a distal end thereof for dispersing shot, wherein a proximal end of the control cage is connected to a second side of the housing, opposite the first side, around an opening of an intake disposed at the second side, wherein the control cage is disposed with a clearance between inner ends of the blades and an outer surface of the distributor and extends over a length of the impeller, and a nozzle connected to the second side of the housing to supply the opening of the intake with shot, wherein a supporting member is disposed at a side of the impeller to support the rotating impeller during rotation thereof.

2. The centrifugal projecting machine of claim 1, wherein the impeller comprises:

a first side-plate located near the driving shaft of the driving means, a second side-plate located near the nozzle and set apart from the first side-plate by a predetermined distance, wherein the second side-plate at a central portion thereof has an opening larger than an outer diameter of the control cage, and a plurality of blades radially located between the first side-plate and the second side-plate, wherein the supporting member is at least disposed between the first side-plate of the impeller and the proximal end of the control cage.

3. The centrifugal projecting machine of either claim 1 or 2, wherein the supporting member is a bearing.

4. The centrifugal projecting machine of claim 3, wherein the bearing is a rolling bearing.

5. The centrifugal projecting machine of claim 3, wherein the bearing is an oil-impregnated sintered bearing.

6. The centrifugal projecting machine of claim 3, wherein the bearing is a ceramic bearing.

7. The centrifugal projecting machine of either claim 1 or 2, wherein the supporting member is made of a ceramic material.

8. The centrifugal projecting machine of either claim 1 or 2, wherein the supporting member is made of a hard resin material.

9. The centrifugal projecting machine of either claim 1 or 2, wherein the supporting member is made of an oil-impregnated sintered material.

10. The centrifugal projecting machine of either claim 1 or 2, wherein the supporting member comprises a plurality of material laid in a circumferential direction.

11. A centrifugal projecting machine comprising:

a housing, a driving means having a driving shaft disposed at a first side of the housing, a rotating impeller having a plurality of blades, the impeller being connected to the driving shaft of the driving means for rotation, a distributor disposed in an inner cylindrical space of the impeller so that it is concentrically arranged in relation to the driving shaft, the distributor having openings that are circumferentially disposed at substantially equal intervals, a control cage having an opening around a distal end thereof for dispersing shot, wherein a proximal end of the control cage is connected to a second side of the housing, opposite the first side, around an opening of an intake disposed at the second side, wherein the control cage is disposed with a clearance between inner ends of the blades and an outer surface of the distributor and extends over a length of the impeller, and a nozzle connected to the second side of the housing to supply the opening of the intake with shot, wherein a rotating member is disposed for sealing between a proximal end of the distributor and a distal end of the control cage.

12. The centrifugal projecting machine of claim 11, wherein the impeller comprises:

a first side-plate located near the driving shaft of the driving means, a second side-plate located near the nozzle and set apart from the first side-plate by a predetermined distance, wherein the second side-plate at a central portion thereof has an opening larger than an outer diameter of the control cage, and a plurality of blades radially located between the first side-plate and the second side-plate.

13. The centrifugal projecting machine of either claim 11 or 12, wherein the rotating member for sealing is made of a ceramic material.

14. The centrifugal projecting machine of either claim 11 or 12, wherein the rotating member for sealing is made of an oil-impregnated sintered material.

15. The centrifugal projecting machine of either claim 11 or 12, wherein the rotating member for sealing is made of hard resin material.

16. A centrifugal projecting machine comprising:

a housing, a driving means having a driving shaft disposed at a first side of the housing with a flange, a rotating impeller having a plurality of blades, the impeller being connected to the driving shaft of the driving means by means of a hub for rotation, a distributor disposed in an inner cylindrical space of the impeller so that it is concentrically arranged in relation to the driving shaft, the distributor having slit-like openings that are circumferentially disposed at substantially equal intervals, a control cage having an opening around a distal end thereof for dispersing shot, wherein a proximal end of the control cage is connected to a second side of the housing, opposite the first side, around an opening of an intake disposed at the second side, wherein the control cage is disposed with a clearance between inner ends of the blades and an outer surface of the distributor and extends over a length of the impeller, and a nozzle connected to the second side of the housing to supply the opening of the intake with shot, wherein a bearing is disposed at a clearance between an inner periphery of the flange and an outer periphery of the hub together with damping members.

17. The centrifugal projecting machine of claim 16, wherein the damping members are disposed in grooves formed at the inner periphery of the flange.

18. The centrifugal projecting machine of claim 16, wherein the damping members are O-rings disposed in ring-shaped grooves formed at the inner periphery of the flange.

19. The centrifugal projecting machine of claim 16, wherein the damping members are disposed around an outer periphery of an outer ring of the bearing.

20. The centrifugal projecting machine of any one of claims 16 to 19, wherein the damping members are made of materials selected from the group consisting of a rubber material, a resin material, and a metal material for damping.

21. The centrifugal projecting machine of any one of claims 16 to 19, wherein the bearing is a ball bearing.

22. The centrifugal projecting machine of claim 21, wherein at least balls that constitute a part of the ball bearing are made of a ceramic material.

23. The centrifugal projecting machine of any one of claims 16 to 19, wherein the bearing is a double row bearing.

* * * * *